US010631094B2

(12) United States Patent
Lilienthal et al.

(10) Patent No.: US 10,631,094 B2
(45) Date of Patent: Apr. 21, 2020

(54) INVERTED MOTOR TRANSDUCER WITH CENTRAL VENT

(71) Applicant: Harman International Industries, Incorporated, Stamford, CT (US)

(72) Inventors: Toni Otto Lilienthal, Northridge, CA (US); Alexander Voishvillo, Simi Valley, CA (US)

(73) Assignee: Harman International Industries, Incorpcrated, Stamford, CT (US)

( * ) Notice: Subject to any disclaimer, the term of this patent is extended or adjusted under 35 U.S.C. 154(b) by 0 days.

(21) Appl. No.: 16/003,785

(22) Filed: Jun. 8, 2018

(65) Prior Publication Data

US 2019/0379980 A1 Dec. 12, 2019

(51) Int. Cl.
*H04R 9/02* (2006.01)
*H04R 7/16* (2006.01)

(52) U.S. Cl.
CPC ..... *H04R 9/022* (2013.01); *H04R 7/16* (2013.01); *H04R 9/025* (2013.01)

(58) Field of Classification Search
CPC . H04R 9/022; H04R 1/00; H04R 9/06; H04R 9/00; H04R 9/025
See application file for complete search history.

(56) References Cited

U.S. PATENT DOCUMENTS

| | | | | |
|---|---|---|---|---|
| 8,699,737 | B2 | 4/2014 | Mamin | |
| 9,445,201 | B2 * | 9/2016 | Hyde | H04R 9/06 |
| 9,571,935 | B2 | 2/2017 | Moro | |
| 2006/0008108 | A1 | 1/2006 | Huang et al. | |

FOREIGN PATENT DOCUMENTS

| | | | |
|---|---|---|---|
| DE | 3113281 | A1 | 10/1982 |
| JP | H02128494 | U | 10/1990 |
| JP | H0638288 | A | 2/1994 |
| WO | 2006091747 | A1 | 8/2006 |

* cited by examiner

*Primary Examiner* — Amir H Etesam
(74) *Attorney, Agent, or Firm* — Brooks Kushman P.C.

(57) ABSTRACT

An electrodynamic transducer includes a rear frame defining an open frame interior and having an annular base. A central vent extends through the transducer along a central axis, where a first segment of the central vent extends upwardly from the base. A movable diaphragm is positioned within the open frame interior and operably connected to the rear frame. A magnet assembly is concentrically disposed with respect to a second segment of the central vent and coupled to a third segment of the central vent forward of the diaphragm, wherein a magnetic air gap is defined between the magnet assembly and the central vent. A voice coil is disposed within the magnetic air gap and operably connected to the diaphragm. The central vent allows bi-directional air flow in and out of the transducer. When the transducer is mounted in an enclosure, the central vent may function as a Helmholtz port.

20 Claims, 4 Drawing Sheets

INVERTED MOTOR TRANSDUCER WITH CENTRAL VENT

TECHNICAL FIELD

Embodiments relate to an inverted motor transducer, such as a low-frequency woofer, with a central vent.

BACKGROUND

An electrodynamic transducer may be utilized as a loudspeaker or as a component in a loudspeaker system to transform electrical signals into acoustical signals. In a typical loudspeaker system, the transducer includes a magnetic motor assembly including one or more permanent magnets mounted between a top plate and a back plate, and a voice coil attached to a coil former and axially movable with respect to the motor assembly. The coil former and attached voice coil are inserted into an air gap of the motor assembly such that the voice coil is exposed to the magnetic field established by the motor assembly. The coil former is attached to a diaphragm constructed from a flexible material that is responsive to a vibrational input, such that the diaphragm is mechanically referenced to the voice coil.

During operation of the loudspeaker, electrical energy is supplied to the voice coil, causing the voice coil and attached diaphragm to move axially within the air gap. Electrical signals are transmitted as an alternating current through the voice coil, and the alternating current interacts with the constant magnetic field in the air gap. The interaction results in a Laplace force which is expressed as a product of the magnetic flux density, overall length of the turns of the voice coil linked to the magnetic flux, and the value of the electrical current running through the voice coil. Due to the Laplace force acting on the voice coil positioned in the magnetic field, the alternating current actuates the voice coil to reciprocate back and forth in the air gap and, correspondingly, move the diaphragm to which the coil former is attached. Accordingly, the reciprocating voice coil actuates the diaphragm to likewise reciprocate and, consequently, produce acoustic signals that propagate as sound waves.

Since the material of the voice coil has an electrical resistance, some of the electrical energy flowing through the voice coil is converted to heat energy instead of sound energy. Heat produced by the voice coil can build up and be radiated to surrounding surfaces of the transducer. The generation of resistive heat is disadvantageous for several reasons. First, the conversion of electrical energy to heat energy constitutes a loss in the efficiency of the transducer in performing its intended purpose, that of converting the electrical energy to mechanical energy utilized to produce acoustic signals. Second, excessive heat may damage the components or electrical interconnects of the loudspeaker and/or degrade the adhesives often employed to attach various components together, and may even cause the loudspeaker to cease functioning. Increase of the voice coil temperature is accompanied by the increase of the voice coil's direct current resistance (DCR). Since all modern amplifiers are sources of voltage, the increase of DCR causes the decrease of sound pressure level (SPL) output. A voice coil temperature of 250 C corresponds to approximately double the DCR and, correspondingly, −6 dB drop in SPL which is also accompanied by a change of frequency caused by undamping of the loudspeaker's motor.

As additional examples, the voice coil may become detached from the coil former and consequently fall out of proper position relative to other components of the transducer, which adversely affects the proper electromagnetic coupling between the voice coil and the motor assembly and the mechanical coupling between the voice coil and the diaphragm. Also, excessive heat will cause certain magnets to become demagnetized. Thus, the generation of heat limits the power handling capacity and distortion-free sound volume of loudspeakers as well as their efficiency. Such problems are exacerbated by the fact that electrical resistance through a voice coil increases with increasing temperature. That is, the hotter the wire of the voice coil becomes, the higher its electrical resistance becomes and the more heat it generates.

The most common form of loudspeaker uses a single voice coil winding in a single magnetic air gap. However, loudspeaker performance may be enhanced by using a multiple coil/multiple gap design. A multi-coil transducer may include two or more separate windings axially spaced apart from each other to form two or more coils which are usually electrically connected so that the coils work together to move the diaphragm. As both coils provide forces for driving the diaphragm, the power output of the loudspeaker may be increased without significantly increasing size and mass. Many multi-coil/multi-gap designs are able to produce more power output per transducer mass and dissipate more heat than conventional single-coil designs. For example, a dual-coil design provides more coil surface area compared with many single-coil configurations, and thus is capable of dissipating a greater amount of heat at a greater rate of heat transfer.

While the multiple coil/multiple gap construction has several advantages over single coil/single gap designs including higher power handling, reduced distortion, reduced inductance, and extended frequency response, there are several disadvantages with dual coil/dual gap speakers. First, insofar as a desired advantage of the dual-coil transducer is its ability to operate at a greater power output, operating the dual-coil transducer at the higher power output concomitantly causes the dual-coil transducer to generate more heat. As such, the improved heat dissipation inherent in the dual-coil design may be offset by the greater generation of heat. There can also be problems with overheated magnets due to the compact magnet assembly and the proximity of the magnets to the heat-generating voice coils. For example, as compared to single-coil transducers, adequate heat dissipation in many dual-coil transducers is a problem due to the longer thermal paths that must be traversed between the voice coil and the ambient environment.

SUMMARY

In one or more embodiments, an electrodynamic transducer includes a rear frame defining an open frame interior and having an annular base, the rear frame including a hollow pedestal extending upwardly from the base into the frame interior and disposed about a central axis of the transducer. A movable diaphragm is positioned within the open frame interior and operably connected to the rear frame, and a hollow pole piece is coupled to the pedestal and disposed about the central axis. The transducer includes a magnet assembly concentrically disposed with respect to the pole piece forward of the diaphragm, wherein a magnetic air gap is defined between the magnet assembly and the pole piece. A voice coil is disposed in the magnetic air gap and operably connected to the diaphragm, and a hollow center hub is coupled to the pole piece and disposed about the central axis, the magnet assembly coupled to the center hub. A central vent extending through the transducer is collectively formed by the pedestal, the pole piece, and the center hub, the central vent allowing bi-directional air flow in and out of the transducer.

In one or more embodiments, an electrodynamic transducer includes a rear frame defining an open frame interior and having an annular base. A central vent extends through the transducer along a central axis of the transducer, a first segment of the central vent extending upwardly from the base. A movable diaphragm is positioned within the open frame interior and operably connected to the rear frame. The transducer further includes a magnet assembly concentrically disposed with respect to a second segment of the central vent and coupled to a third segment of the central vent forward of the diaphragm, wherein a magnetic air gap is defined between the magnet assembly and the central vent. A voice coil is disposed within the magnetic air gap and operably connected to the diaphragm. The central vent allows bi-directional air flow in and out of the transducer.

In one or more embodiments, a loudspeaker system includes an enclosure and a transducer mounted within the enclosure. The transducer includes a rear frame defining an open frame interior and having an annular base, and a central vent extending through the transducer along a central axis of the transducer, a first segment of the central vent extending upwardly from the base. The transducer further includes a movable diaphragm positioned within the open frame interior and operably connected to the rear frame, and a magnet assembly concentrically disposed with respect to a second segment of the central vent and coupled to a third segment of the central vent forward of the diaphragm and outside of the enclosure, wherein a magnetic air gap is defined between the magnet assembly and the central vent. Still further, the transducer includes a voice coil disposed within the magnetic air gap and operably connected to the diaphragm. Resonance within the enclosure pumps air through the central vent such that the central vent functions as a Helmholtz port.

DETAILED DESCRIPTION

Figure 1:
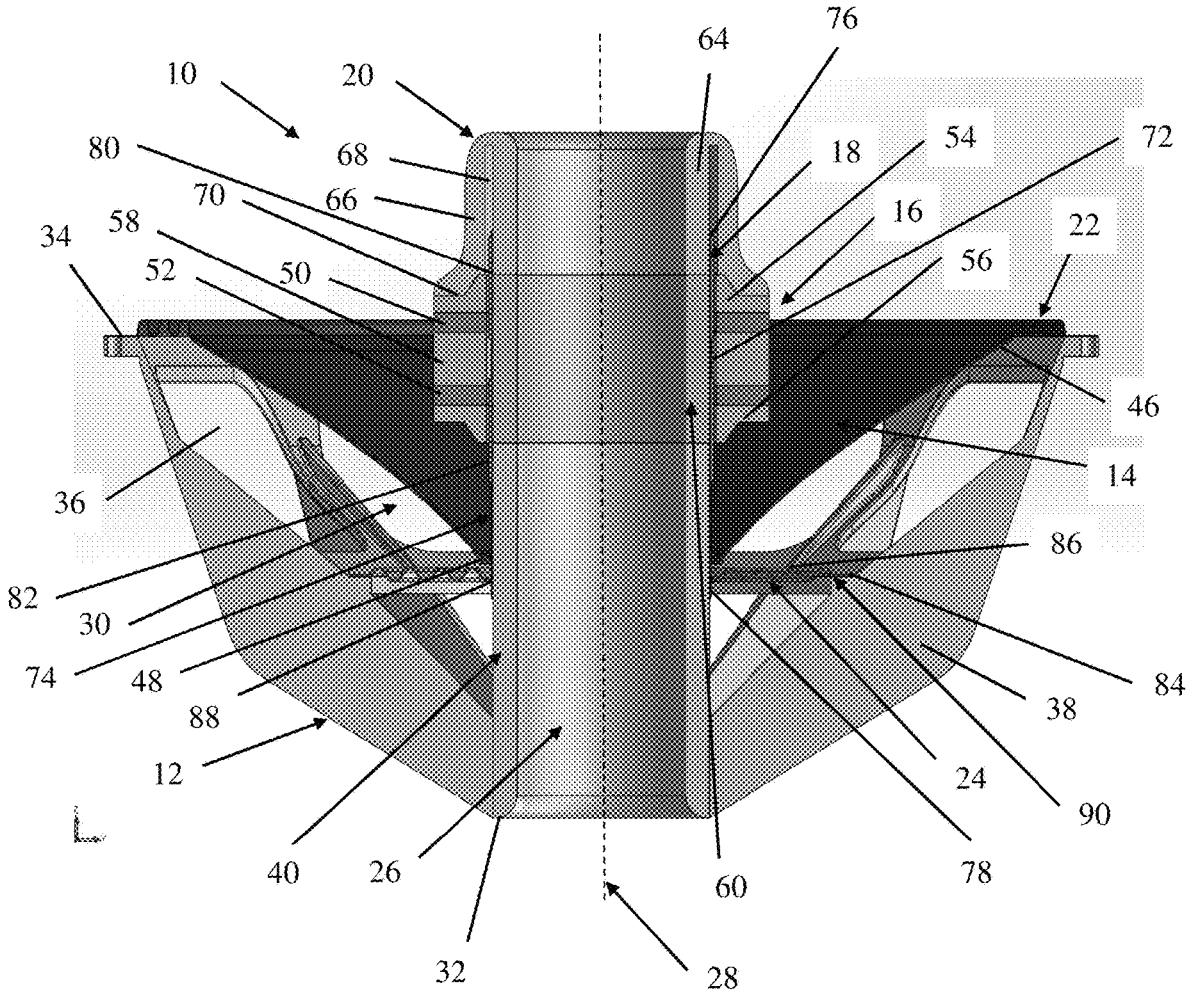
FIG. 1 is a cross-sectional view of an inverted motor transducer having a central vent according to an embodiment.

As required, detailed embodiments are disclosed herein; however, it is to be understood that the disclosed embodiments are merely exemplary of the subject matter that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the subject matter.

Inverted motor transducers, mainly low-frequency woofers, have the motor assembly and voice coil positioned in front of the diaphragm, and offer several advantages over transducers with motors positioned behind the diaphragm. The first advantage is a shallower profile that makes an inverted motor transducer particularly popular in automotive audio systems where space is limited. The second advantage is better voice coil cooling since the coil is positioned outside the enclosure of a loudspeaker where the ambient temperature is typically lower than inside the enclosure. The lower temperature of the voice coil decreases thermal compression. In addition, the lower motor temperature decreases the risk of the demagnetization of magnets in the motor assembly. The third advantage is a better dynamic stability of the moving assembly because its gravity center is located between two suspension points, instead of outside the suspension points as in regular transducers.

Embodiments disclosed herein include an inverted motor transducer with a central vent of large diameter and length. The central vent provides a flow path for the transfer of cooling air between outside ambient space and the volume inside a loudspeaker enclosure, where the central vent and the enclosure volume act as a Helmholtz resonator. The central vent increases voice coil cooling in inverted motor transducers equipped with a single or dual voice coil. In addition to providing an increase in cooling, the central vent may perform the functions of a port in a vented box enclosure. The central vent may act as a port by itself or in combination with the regular port of a low-frequency vented box enclosure. Advantages of the disclosed central vent configuration include an increased thermal performance with minimal SPL reduction or loss of sensitivity. The disclosed embodiments generate airflow directly through the motor structure, instead of requiring another component within the enclosure, such as an electric fan.

Some prior art transducers have employed the dust dome as a "pump" to move air through a vent in the annular motor structure. Such vents have been used for releasing pressure under the dust dome to influence the overall air stiffness and damping, for reducing the air flow along the voice coil to control noise (while the cooling effect suffers), for material saving, or for generating a higher magnetic flux density, sometimes to drive steel into saturation. Even if such motor venting was intended to be an improvement of thermal behavior, in these prior art configurations it often resulted in a thermal disadvantage. In contrast, in the embodiments disclosed herein, air flow through the central vent is created in response to system resonance, instead of movement of the diaphragm with the excursion of the voice coil. The disclosed transducer eliminates both the dust dome and the unnecessary front frame. Air is pumped through the motor assembly along an extended and widened central vent, where extension of the central vent can be used to lower the tuning frequency of the loudspeaker system. The air flow cools the metal core, instead of traveling along the voice coil, and thus affects the long-term cooling of the transducer.

Figure 2:
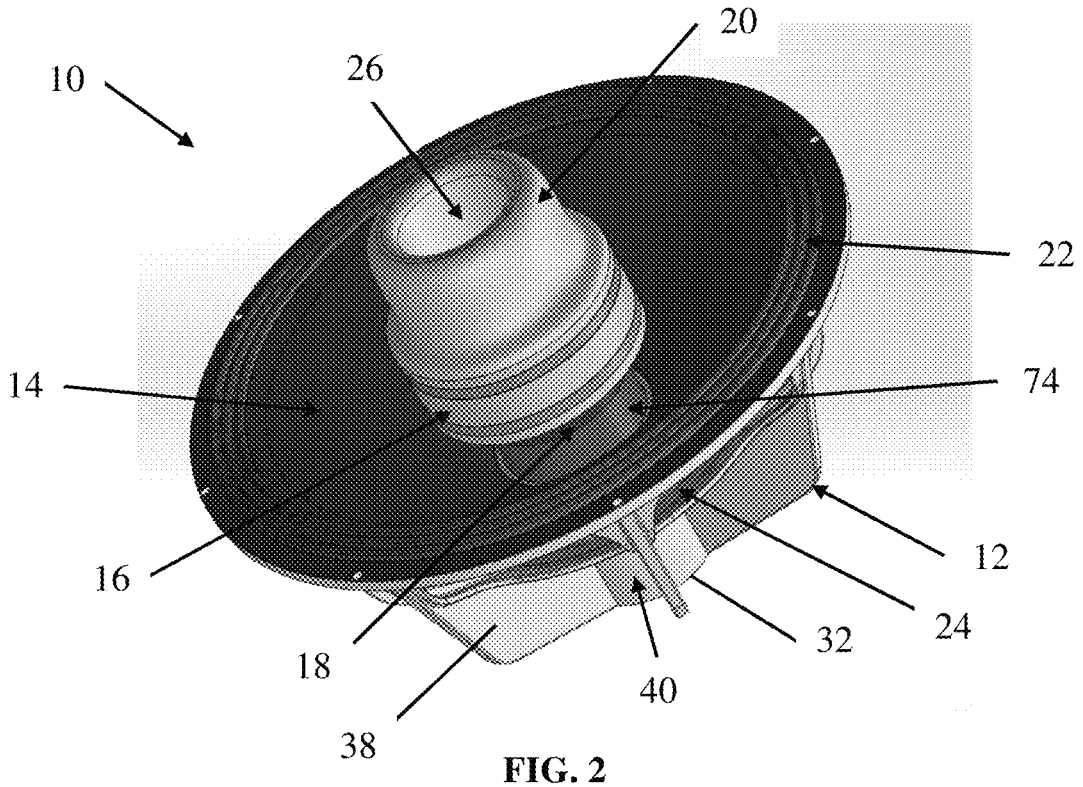
FIG. 2 is a top perspective view of the transducer.
Figure 3:
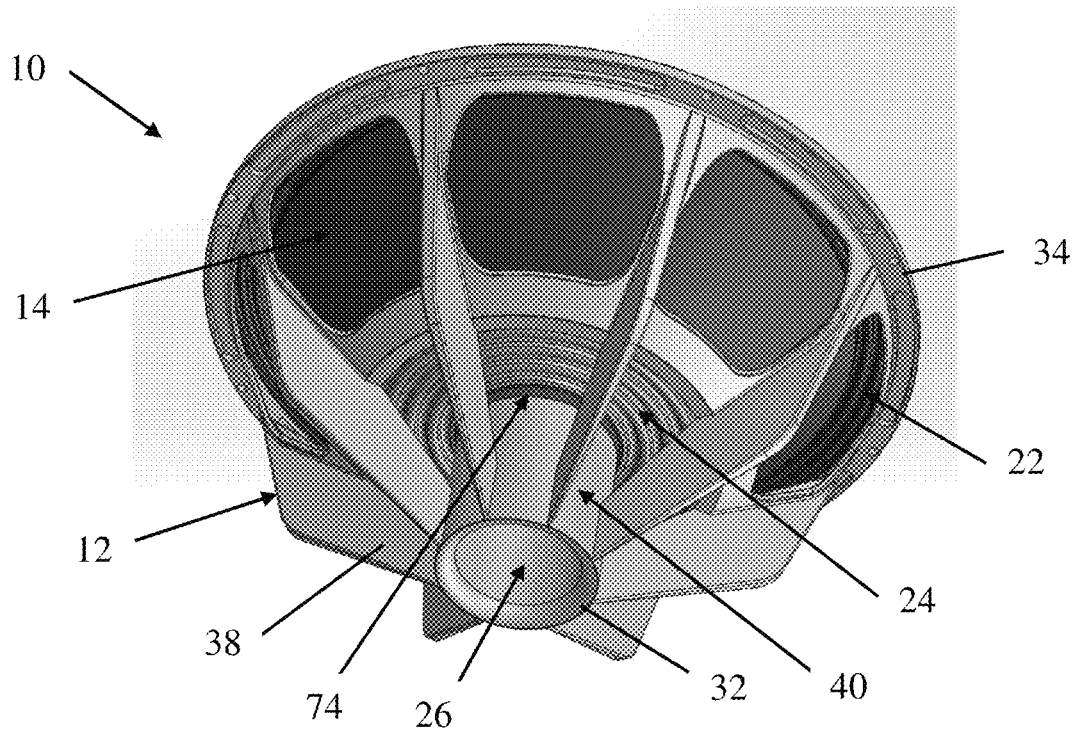
FIG. 3 is a bottom perspective view of the transducer.

FIGS. 1-3 illustrate an embodiment of an electrodynamic transducer 10 having an inverted motor configuration. The transducer 10 includes a basket or rear frame 12, a cone or diaphragm 14, a magnet assembly 16, a voice coil 18, a center hub 20, and a suspension system including a surround 22 and a spider 24. Of note is that the transducer 10 does not include a front frame, thus having the advantage of decreasing the weight of the transducer 10.

The disclosed transducer 10 includes a central vent 26 that extends through the transducer 10 along a central axis 28, where the central vent 26 is a source of bi-directional air flow in and out of the transducer 10. The central vent 26 may comprise a cylindrical shape and may have a uniform diameter along its length, which may facilitate air flow. Both the diameter and length of the central vent 26 may be relatively large with respect to an overall diameter of the transducer 10, also facilitating the flow of air through the central vent 26 and thus the transducer 10. For example, in an 18 in. woofer, the central vent 26 may have an inner diameter of between about 2 in.-5 in. and a length of about 12 in. In general, the central vent 26 may have a diameter which is between about 10% to 25% of the diameter of the transducer 10, and the central vent 26 may have a length which is between about 60% to 70% of the diameter of the transducer 10. The airflow provided by the central vent 26 can be beneficial for self-cooling of the transducer 10 as high-speed air flows past the components in the vicinity of the central vent 26. The central vent 26 will be further described below with reference to other components of the transducer 10.

As best shown in FIGS. 1 and 3, the rear frame 12 may include a conical construction or other shape defining an open frame interior 30, an annular base 32 and a top landing 34. The rear frame 12 may include one or more cut-outs 36 which define a series of struts 38 extending between the top landing 34 and the base 32. The rear frame 12 includes a hollow, generally cylindrical pedestal 40 extending from the base 32 into the frame interior 30 along the central axis 28. The pedestal 40 may define a first segment of the central vent 26 through the transducer 10. The annular base 32 may have a rounded edge or flared configuration to form one end of the central vent 26. As shown, the pedestal 40 and therefore the central vent 26 extend significantly below the spider 24. In one or more embodiments, approximately 25% to 35% of a length of the central vent 26 extends below the spider 24 and/or approximately 50% to 75% of the length of the pedestal 40 extends below the spider 24. The rear frame 12 may generally be constructed from pressed sheet metal, molded from plastic or cast metal such as aluminum or steel, or other suitable material.

The diaphragm 14, while it may be of any shape, is shown as being generally conical, and is operably connected to the rear frame 12. In one or more embodiments, the diaphragm 14 has a first end 46 attached to the surround 22 and a second end 48 attached to the voice coil 18, such as by conventional adhesives. As shown, the diaphragm 14 is positioned within the open frame interior 30. The diaphragm 14 may be made from various materials including paper, polymer, metal-based compositions, or other material known in the art for use with diaphragms.

The magnet assembly 16 is positioned forward of the diaphragm 14. In one or more embodiments, the magnet assembly 16 includes a first annular magnet 50 and a second annular magnet 52 coupled between a front annular plate 54 and a back annular plate 56, with an annular spacer 58 in between the first and second magnets 50, 52. However, in other implementations, the magnet assembly 16 may simply include one, or three or more magnets, and it is understood that other configurations of the magnets and plates may alternatively be utilized. As shown, the front plate 54, the first magnet 50, the spacer 58, the second magnet 52, and the back plate 56 are concentrically disposed with respect to a hollow, generally cylindrical pole piece 60 which is coupled to the pedestal 40 and which may define a second segment of the central vent 26. The components of the magnet assembly 16 may be held together by any number of methods, including mechanical fasteners or adhesives. In the present example, the first and second magnets 50, 52 may be made of neodymium, a material that has a high magnetic flux per mass, but could alternatively be constructed of any number of available permanent magnet materials. The front and back plates 54, 56 may be made of ferromagnetic steel or other suitable material with a high magnetic permeability.

The center hub 20 is coupled to the pole piece 60 and may include a hollow, generally cylindrical configuration having an inner wall 64, an outer wall 66, and an annular interior 68 formed between the inner 64 and outer 66 walls. The center hub 20 may define a third segment of the central vent 26, where the inner wall 64 may have a rounded edge or flared configuration to form another end of the central vent 26. The center hub 20 and thus the central vent 26 extend above the diaphragm 14 and, in one or more embodiments, 100% of the center hub 20 is disposed above the diaphragm 14. The outer wall 66 may be angled or otherwise configured near an open end 70 of the annular interior 68 to accommodate the magnet assembly 16. The magnet assembly 16 is coupled to and secured in place with respect to the center hub 20 by an adhesive, press fit, or other means. The center hub 20 may be made from pressed metal, aluminum, cast or forged steel, plastic, ceramic, or any other suitable material. In the embodiments disclosed herein, the transducer 10 does not include a center cap or dust dome.

As described above, the central vent 26 may be collectively formed by three joined segments, namely the pedestal 40 as a first segment, the pole piece 60 as a second segment, and the center hub 20 as a third segment. In other embodiments, one or more of the center hub 20, the pole piece 60, and the pedestal 40 may be integrally formed to create the central vent 26. As such, in some instances the central vent 26 may be a unitary structure.

An annular magnetic air gap 72 is formed between the magnet assembly 16 and the pole piece 60. The voice coil 18 encloses the magnet assembly 16 and is positioned within the magnetic air gap 72, wherein the voice coil 18 is operably connected to the diaphragm 14. The voice coil 18 may be wound about and securely attached to a cylindrical coil former 74, such as by an adhesive. The coil former 74 may have a top end 76 extending into the hub annular interior 68 and a bottom end 78 which may be attached to the spider 24 by an adhesive or other suitable means. The coil former 74 may be made of a stiff high temperature resistant material and is free to move axially through the magnetic air gap 72.

In the embodiment shown, the voice coil 18 has a dual coil configuration including two distinct coil portions, such that the voice coil 18 in effect constitutes two individual coils. The voice coil 18 is wound around the coil former 74 for a desired number of turns to form a first coil portion 80, then runs down the side of the coil former 74 for an axial distance, and then is wound around the coil former 74 for a desired number of turns to form a second coil portion 82 that is axially spaced from the first coil portion 80. The position of the first coil portion 80 on the coil former 74 may correspond with the front plate 54. Similarly, the position of the second coil portion 82 on the coil former 74 may correspond with the back plate 56. In other implementations, the voice coil 18 may include a single coil or more than two coil portions.

The spider 24 includes an outer flange 84, an undulation portion 86, and an attachment portion 88. The outer flange 84 may be attached to an intermediate landing 90 of the rear frame 12, and the attachment portion 88 may be attached to the coil former 74 by adhesive or other suitable means. The spider 24 may be made of a variety of materials such as phenolic-impregnated cloth, rubber, plastics, textiles, or other material known in the art. Generally, the spider 24 connects the voice coil 18 to the rear frame 12, and assists in centering the voice coil 18 in the magnetic gap 72 and about the magnet assembly 16.

The surround 22 is connected between the top landing 34 and the diaphragm 14 by adhesive or other suitable means, coupling the rear frame 12 to the diaphragm 14. The surround 22 may be made of materials such as rubber, compressed foam rubber, corrugated cloth, paper, plastic, treated fabrics, or other suitable material. The surround 22 functions to constrain the diaphragm 14 radially while allowing it to vibrate in an axial direction when driven by the voice coil 18. The surround 22 provides a degree of constraint to the maximum excursions of the voice coil 18 and keeps the voice coil 18 centered with the magnetic air gap 72.

The voice coil 18 may be connected to any suitable circuitry (including, for example, an amplifier) for driving the transducer 10. The voice coil 18 oscillates in response to electrical current while being subjected to the constant magnetic field across the magnetic air gap 72 established by the magnetic assembly 16. In operation, the coil former 74 oscillates with the voice coil 18 and the oscillations are translated to the diaphragm 14, thus producing mechanical sound energy correlating to the electrical signals transmitted through the voice coil 18. The acoustic signals propagate or radiate from the vibrating diaphragm 14 to the ambient environment. The large central vent 26 disclosed herein improves the cooling capability of the voice coil 18 and magnet assembly 16 in the inverted transducer 10 as compared to prior art configurations.

Figure 4:
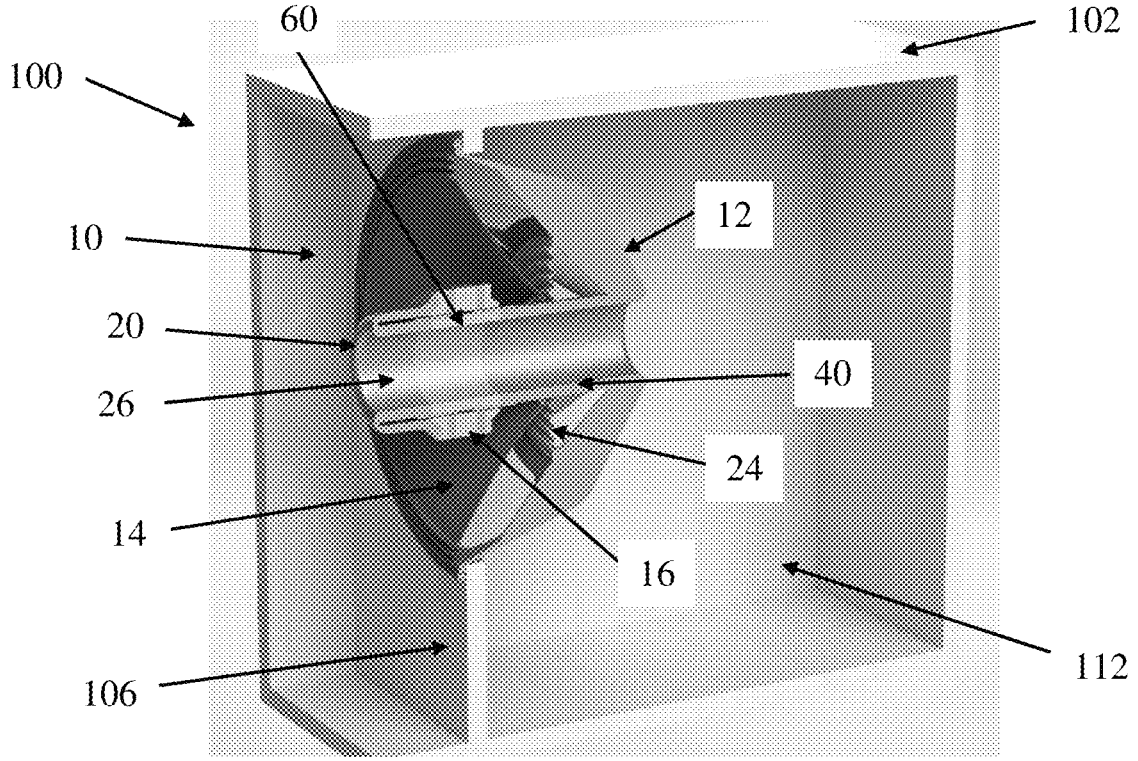
FIG. 4 is a perspective, partially cutaway view illustrating an inverted motor transducer having a central vent within an enclosure.

In addition to providing an increase in cooling, the central vent 26 may perform the functions of a port in a vented box enclosure. With reference to FIG. 4, a loudspeaker system 100 is illustrated where the transducer 10 is mounted within an enclosure 102, with the magnet assembly 16 outside of the enclosure 102, and where the central vent 26 is used as a standalone port. The loudspeaker system 100 may include additional internal components within the enclosure 102 such as, but not limited to, an amplifier (not shown). During operation, current from the amplifier or some other device supplying electrical signals drives the voice coil 18, and axial reciprocation of the voice coil 18 in the magnetic air gap 72 in connection with the diaphragm 14 generates sound representing the program material transduced by the transducer 10. The vibrating transducer 10 emits sound waves in front of the diaphragm 14 and, as the diaphragm 14 moves back and forth, rear waves are created behind the diaphragm 14 as well. Many speakers take advantage of these rear waves to supplement forward sound waves produced by the diaphragm 14. System resonance may be used to pump air through the central vent 26 to provide efficient forced air cooling to the transducer 10, and heat can be dissipated by passing hot air through the central vent 26 to the ambient environment. The large diameter of the central vent 26 is similar to the diameter of a typical port in a vented enclosure and therefore may function as a Helmholtz port, thus eliminating the need for an additional port in the enclosure to provide bass reflex functionality.

Figure 5:
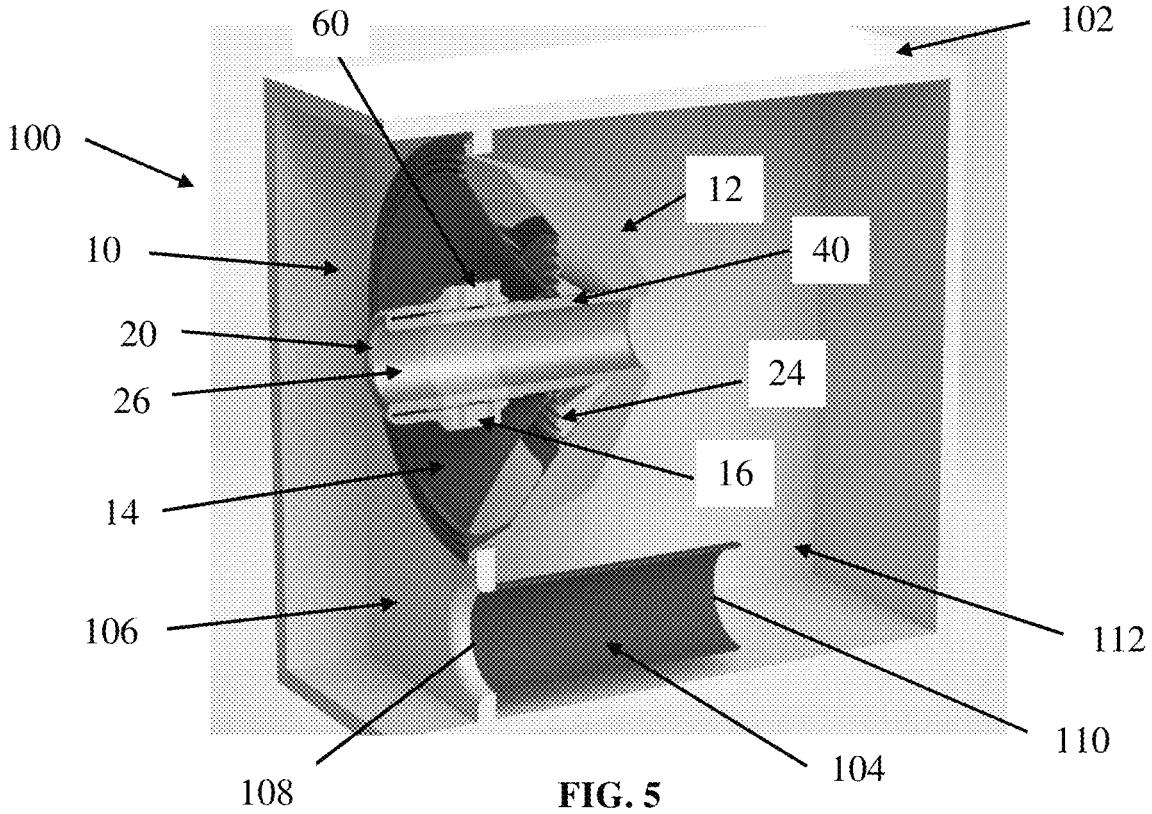
FIG. 5 is a perspective, partially cutaway view illustrating the transducer within a vented enclosure.

The central vent 26 can also be used in a combination with a regular port 104 of a vented box enclosure, such as depicted in FIG. 5. In this embodiment, the backward motion of the diaphragm 14 excites the resonance created by the spring of air inside the enclosure 102 and the air contained within the port 104. The length and area of the port 104 are generally sized to tune this resonant frequency. As shown in FIG. 5, the port 104 may be disposed in a front wall 106 of the enclosure 102, although this illustrated placement is not intended to be limiting. The port 104 has an inlet 108 located at the front wall 106 or another external surface of the enclosure 102, and an outlet 110 located in an interior 112 of the enclosure 102. The port 104, which may be referred to as a Helmholtz port, is a source of high velocity, bi-directional air flow in and out of the inlet 108 and outlet 110. In the embodiment depicted, the port 104 has a generally cylindrical configuration of uniform diameter, although it is understood that the port 104 is not limited to this geometry. Furthermore, although only one port 104 is shown, additional ports may be included in the loudspeaker system 100.

As described above, one advantage of removing the dust dome according to the present embodiments is that it allows significant simplification of the transducer configuration by allowing elimination of the front frame. For reference, the tuning frequency of a transducer with a dust dome is expressed as:

$$f_b = \frac{1}{2\pi\sqrt{M_{av}C_{ab}}} \tag{1}$$

where $M_{av}$ is the acoustical mass of the central vent and $C_{ab}$ is the acoustical compliance of the enclosure's volume.

Correspondingly, the acoustical mass of the central vent can be approximately expressed as:

$$M_{av} = \frac{\rho l_v}{s_v} \tag{2}$$

where ρ is the air density, $l_v$ is the length of the vent and $S_v$ is the vent's cross-section area. In practical applications, the vent's profile is not constant but has flares at the edges to mitigate the possibility of airflow turbulence. For clarity, we will consider the cross-section constant.

The acoustical compliance of the enclosure volume is expressed as:

$$C_{ab} = \frac{V_b}{\rho c^2} \tag{3}$$

where $V_b$ is the enclosure's volume, and c is sound speed. Therefore, the tuning frequency is:

$$f_b = \frac{c}{2\pi}\sqrt{\frac{S_v}{l_v V_b}} \tag{4}$$

In the case of the combined ports, the acoustical mass of the central vent $M_{av}$ is combined with the acoustical mass of the port $M_{ap}$ and the tuning frequency $f_{b1}$ is expressed as:

$$f_{b1} = \frac{c}{2\pi}\sqrt{\frac{(l_v S_p + l_p S_v)}{V_b l_v l_p}} \tag{5}$$

where $S_p$ and $l_p$ are the port's cross-section area and length, correspondingly.

The overall tuning frequency $f_{b1}$ can be varied by the changes in the vent and port dimensions. However, for a given cross-sectional area of the central vent (which should be maximally large to minimize airflow turbulence), its tuning cannot be increased but can be lowered by extending the length of the central vent.

Figure 6:
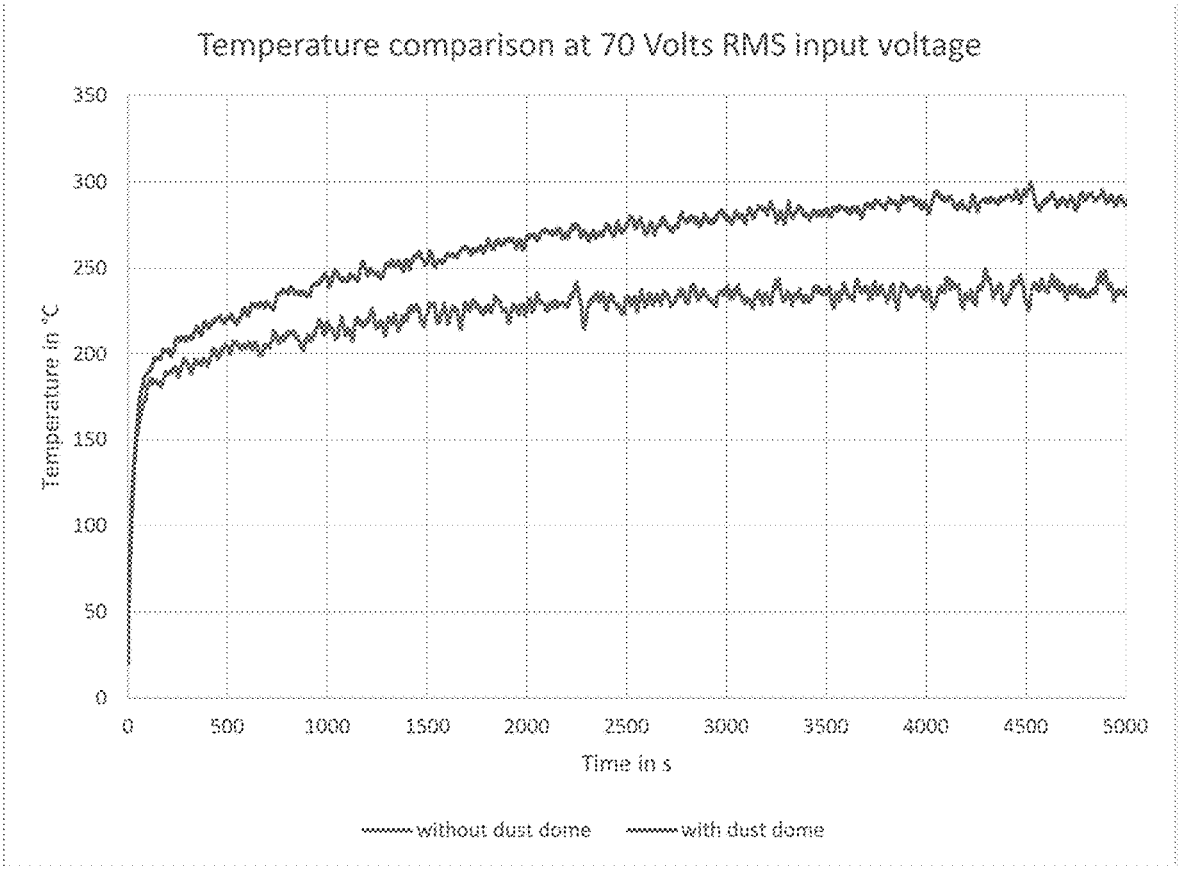
FIG. 6 is a graph showing the difference of the voice coil temperature of an inverted woofer with (lower trace) and without (upper trace) a dust dome.

FIG. 6 shows the difference in the voice coil temperature of an 18" inverted woofer based on a 4" dual voice coil with and without a dust dome during a power test (Klippel Power Test Analyzer). The lower trace corresponds to the presence of the dome and the upper trace corresponds to the absence of the dome. With a dust dome, only a small amount of air can be displaced through a center vent because of the small area of the dome compared to the diaphragm. Without the dust dome, the volume of air circulating through the central vent is significantly higher, and therefore the cooling effect of the motor is much stronger.

While exemplary embodiments are described above, it is not intended that these embodiments describe all possible forms of the subject matter. Rather, the words used in the specification are words of description rather than limitation, and it is understood that various changes may be made without departing from the spirit and scope of the subject matter disclosed herein. Additionally, the features of various implementing embodiments may be combined to form further embodiments.

What is claimed is:

1. An electrodynamic transducer, comprising:

a rear frame defining an open frame interior and having an annular base, the rear frame including a hollow pedestal extending upwardly from the base into the frame interior and disposed about a central axis of the transducer;

a movable diaphragm positioned within the open frame interior and operably connected to the rear frame;

a hollow pole piece coupled to the pedestal and disposed about the central axis;

a magnet assembly concentrically disposed with respect to the pole piece forward of the diaphragm, wherein a magnetic air gap is defined between the magnet assembly and the pole piece;

a voice coil disposed in the magnetic air gap and operably connected to the diaphragm; and a hollow center hub coupled to the pole piece and disposed about the central axis, the magnet assembly coupled to the center hub;

wherein a central vent extending through the transducer is collectively formed by the pedestal, the pole piece, and the center hub without a dust dome, the central vent allowing bi-directional air flow in and out of the transducer.

2. The transducer of claim 1, wherein the central vent is generally cylindrical and has a uniform diameter along a length of the central vent.

3. The transducer of claim 1, wherein the central vent has a diameter which is between about 10% to 25% of a diameter of the transducer.

4. The transducer of claim 1, wherein one or more of the center hub, the pole piece, and the pedestal are integrally formed to create the central vent.

5. The transducer of claim 1, wherein the voice coil has a dual coil configuration including a first coil portion spaced from a second coil portion.

6. The transducer of claim 1, wherein the magnet assembly includes a front annular plate spaced from a back annular plate and at least one annular magnet disposed therebetween.

7. The transducer of claim 1, wherein the voice coil is attached to a cylindrical coil former, and the transducer further comprises a spider coupled between the coil former and the rear frame behind the diaphragm.

8. An electrodynamic transducer, comprising:

a rear frame defining an open frame interior and having an annular base;

a central vent extending through the transducer along a central axis of the transducer without a dust dome, a first segment of the central vent extending upwardly from the base;

a movable diaphragm positioned within the open frame interior and operably connected to the rear frame;

a magnet assembly concentrically disposed with respect to a second segment of the central vent and coupled to a third segment of the central vent forward of the diaphragm, wherein a magnetic air gap is defined between the magnet assembly and the central vent; and a voice coil disposed within the magnetic air gap and operably connected to the diaphragm;

wherein the central vent allows bi-directional air flow in and out of the transducer.

9. The transducer of claim 8, wherein the first segment of the central vent includes a hollow pedestal, wherein the second segment of the central vent includes a hollow pole piece, and where the third segment of the central vent includes a hollow center hub.

10. The transducer of claim 8, wherein one or more of the first segment, the second segment, and the third segment are integrally formed to create the central vent.

11. The transducer of claim 8, wherein the central vent is generally cylindrical and has a uniform diameter along a length of the central vent.

12. The transducer of claim 8, wherein the central vent has a diameter which is between about 10% to 25% of a diameter of the transducer.

13. The transducer of claim 8, wherein the voice coil has a dual coil configuration including a first coil portion spaced from a second coil portion.

14. The transducer of claim 8, wherein the magnet assembly includes a front annular plate spaced from a back annular plate and at least one annular magnet disposed therebetween.

15. A loudspeaker system, comprising:

an enclosure;

a transducer mounted within the enclosure, the transducer including:

a rear frame defining an open frame interior and having an annular base;

a central vent extending through the transducer along a central axis of the transducer without a dust dome, a first segment of the central vent extending upwardly from the base;

a movable diaphragm positioned within the open frame interior and operably connected to the rear frame;

a magnet assembly concentrically disposed with respect to a second segment of the central vent and coupled to a third segment of the central vent forward of the diaphragm and outside of the enclosure, wherein a magnetic air gap is defined between the magnet assembly and the central vent; and a voice coil disposed within the magnetic air gap and operably connected to the diaphragm;

wherein resonance within the enclosure pumps air through the central vent such that the central vent functions as a Helmholtz port.

16. The loudspeaker system of claim 15, further comprising a port provided in the enclosure, the port having an inlet located at an external surface of the enclosure and an outlet located in an interior of the enclosure which allow bi-directional air flow in and out of the enclosure.

17. The loudspeaker system of claim 15, wherein the first segment of the central vent includes a hollow pedestal, wherein the second segment of the central vent includes a hollow pole piece, and where the third segment of the central vent includes a hollow center hub.

18. The loudspeaker system of claim 15, wherein one or more of the first segment, the second segment, and the third segment are integrally formed to create the central vent.

19. The loudspeaker system of claim 15, wherein the central vent is generally cylindrical and has a uniform diameter along a length of the central vent.

20. The loudspeaker system of claim 15, wherein the central vent has a diameter which is between about 10% to 25% of a diameter of the transducer.

* * * * *